United States Patent [19]

Marioni et al.

[11] Patent Number: 4,861,240

[45] Date of Patent: Aug. 29, 1989

[54] CENTRIFUGAL PUMP FOR ELECTRIC HOUSEHOLD APPLIANCES SUCH AS WASHING MACHINES, DISHWASHERS AND THE LIKE

[75] Inventors: Elio Marioni; Vittorio Cavalcante, both of Dueville, Italy

[73] Assignee: Askoll S.r.l., Dueville, Italy

[21] Appl. No.: 183,208

[22] Filed: Apr. 19, 1988

[30] Foreign Application Priority Data

Apr. 22, 1987 [IT] Italy ..... 41585 A/87

[51] Int. Cl.[4] ..... F04B 9/00

[52] U.S. Cl. ..... 417/423.3; 417/423.11; 417/424.1; 416/244 R; 464/24; 464/160

[58] Field of Search ..... 417/423.3, 423.6, 423.15, 417/423.11, 424.1; 415/152 A; 416/244 R, 500; 464/24, 160

[56] References Cited

U.S. PATENT DOCUMENTS 4,703,840 11/1987 Bopp ..... 464/24 X 4,750,872 6/1988 Palliser ..... 416/244 R X

*Primary Examiner*—Carlton R. Croyle
*Assistant Examiner*—Eugene L. Szczecina, Jr.
*Attorney, Agent, or Firm*—Guido Modiano; Albert Josif

[57] ABSTRACT

The pump comprises a pump body and a volute, mutually complementary with respect to one another, which once assembled form a waterproof container within which a permanent magnet rotor and an impeller are contained respectively in a first and in a second chamber. The stator part of the electric motor is provided externally to said waterproof container, and thus can never be affected by the liquid. The introduced improvements relate to the coupling between impeller and rotor and to the means adapted to make the rotor chamber waterproof, so that there cannot enter therein foreign matter, and in particular metallic dust, which by remaining associated with the permanent magnet of the rotor would prevent the rotation thereof, blocking its operation.

5 Claims, 3 Drawing Sheets

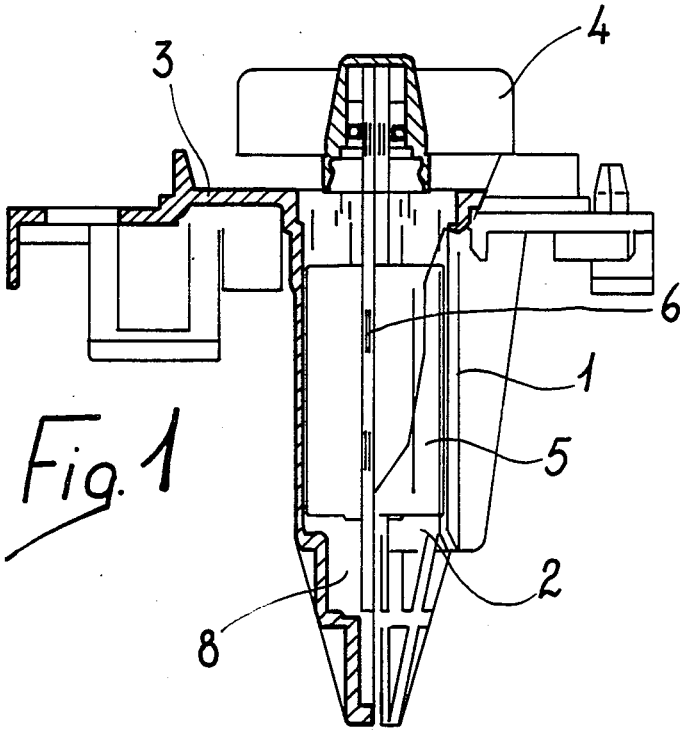
Fig. 1
Fig. 2
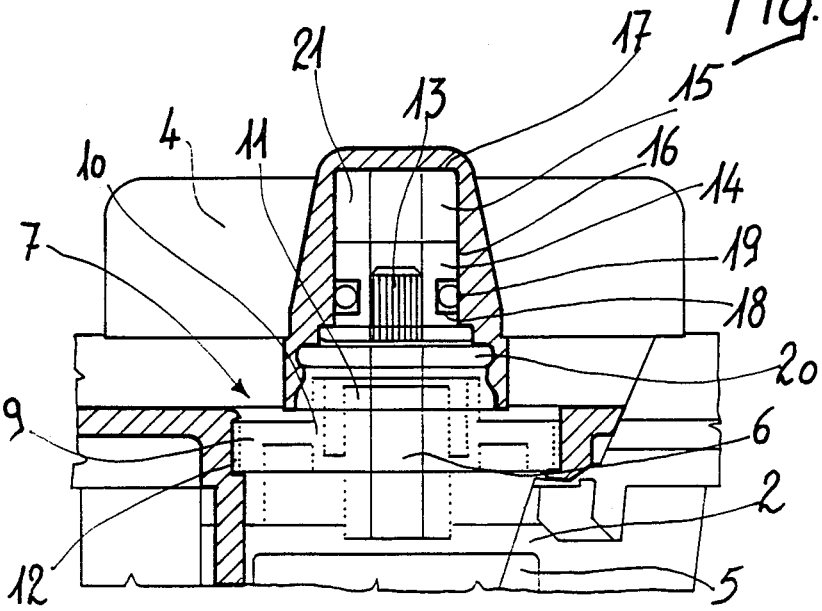

CENTRIFUGAL PUMP FOR ELECTRIC HOUSEHOLD APPLIANCES SUCH AS WASHING MACHINES, DISHWASHERS AND THE LIKE

BACKGROUND OF THE INVENTION

The present invention relates to an improved centrifugal pump for household appliances such as washing machines, dishwashers and the like.

More in particular, the present invention relates to an improved pump to be used in an electrical household appliance, of the type comprising a pump body having a cylindrical chamber containing a permanent magnet rotor.

The electric part of the motor is entirely external to this structure, not being affected in any instance by the liquid.

Known types of pumps thus structured have problems related in particular to the fact that the permanent magnet rotor attracts, and becomes covered with, any metallic dust carried by the pumped liquid.

This dust, once caught by the permanent magnet of the rotor, can no longer detach therefrom, constituting therefore a dangerous jamming and wear element.

Besides this, a permanent magnet pump can start indifferently in one direction or the other, for this reason it is provided that the impeller be not rigidly associated with the motor shaft and the connection be, for a first angle, free and therefore with no mechanical resistance.

This may entail knockings and noises due to the interference of the impeller driving element which, after a certain angle, interferes with said impeller, causing its movement.

SUMMARY OF THE INVENTION

The aim of the present invention is therefore to eliminate the disadvantages observed in this type of pump particularly to ensure a safe operation.

A main object is therefore to provide the pump with improvements suitable to prevent the pumped liquid from affecting the rotor chamber.

A further object is to provide means for coupling the impeller and the rotor such as to prevent the onset of disturbing noises, vibrations or knockings.

Not least object is to provide all these improvements with simple and inexpensive means.

The proposed aim and objects are achieved by an improved centrifugal pump for electrical household appliances such as washing machines, dishwashers and the like, of the type having a pump body and a volute forming a waterproof container, said container enclosing a permanent magnet rotor having a shaft and an impeller in a first and in a a second chamber respectively, characterized in that said first and second chambers are separated by a perforated partition traversed by the shaft, said shaft being connected to said impeller by connection means comprising a tab which is contained in a toroidal cavity of said impeller.

BRIEF DESCRIPTION OF THE DRAWINGS

Further characteristics and advantages of the invention will become apparent from the detailed description of some embodiments given by way of non-limitative example and illustrated in the accompanying drawings tables, wherein:

FIG. 1 is a sectional view of a pump according to the invention;

FIG. 2 is a sectional view of the pump region with the partition separating the two chambers and the coupling between the motor shaft and the impeller;

DESCRIPTION OF THE PREFERRED EMBODIMENTS

Figure 3:
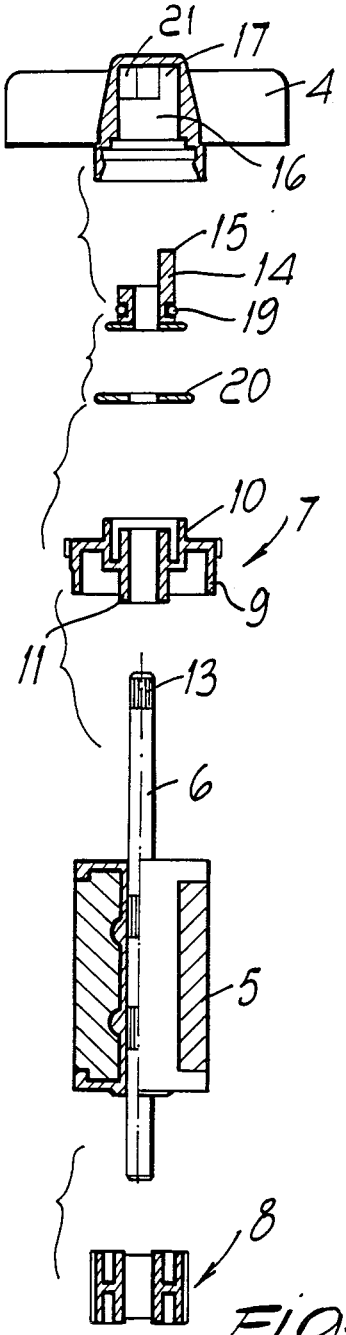
FIG. 3 is an exploded sectional view of the various parts contained within the two chambers of the pump of the type illustrated in FIG. 1.

With reference to the above described figures, the pump according to the invention is composed of a cylindrical body 1 defining a cylindrical chamber 2 termed rotor chamber, perpendicularly associated with a plate 3 which is completed by a volute, not illustrated in the figure, determining a chamber within which there is contained an impeller 4 with symmetrical configuration, since it has to operate in both directions of rotation.

The chamber 2 contains a permanent magnet rotor 5 rigidly associated with a motor shaft 6 frontally supported by a perforated sector 7 and more internally by a second perforated cylindrical body 8.

The perforated sector 7 is composed of an external cylindrical body or first cylindrical body 9 associated by means of a deformable circular crown 10 with a central sleeve 11 provided with a hole through which there passes the motor shaft.

The outer wall of said cylindrical body 7 has a knurled surface 12 adapted to engage in an equivalent knurling present in the inner wall of the rotor chamber 2.

The deformability of the circular crown 10 and of the cylindrical body 8, on which the motor shaft 6 is supported, allows a self-alignment of the supporting points.

With the outer end 13 of the motor shaft 6 there is associated a metallic cylindrical body or second cylindrical body 14 provided with a frontal non-axial tab 15, the entire assembly being contained in an axial cavity of the impeller 4 which comprises a first cylindrical section 16 extending with a deeper toroidal cavity 17 which extends for an angle smaller than 360 degrees.

The front tab 15 of the cylindrical body 14 has a much smaller angular extension than the toroidal cavity 17 within which it is contained.

Said metallic cylindrical body 14 also has a groove 18 within which an O-Ring 19 is inserted which interferes with the cylindrical region 15 of the cavity of the impeller.

To prevent the detachment of the impeller 4 from the cylindrical body 14 there is provided a locking disk 20 elastically locked on the inner wall of the cavity of the impeller 4 so as to lock the cylindrical body 14 though allowing the free rotation of the impeller 4 with respect to the motor shaft 6.

Within the toroidal cavity 17 there is inserted a viscous liquid such as for example an oil or a grease which dampens the motion of the tab 15 within the toroidal cavity 17 avoiding noise in the interference between the tab 15 and the sector 21 which interrupts the continuity of the toroidal cavity 17.

Figure 4:
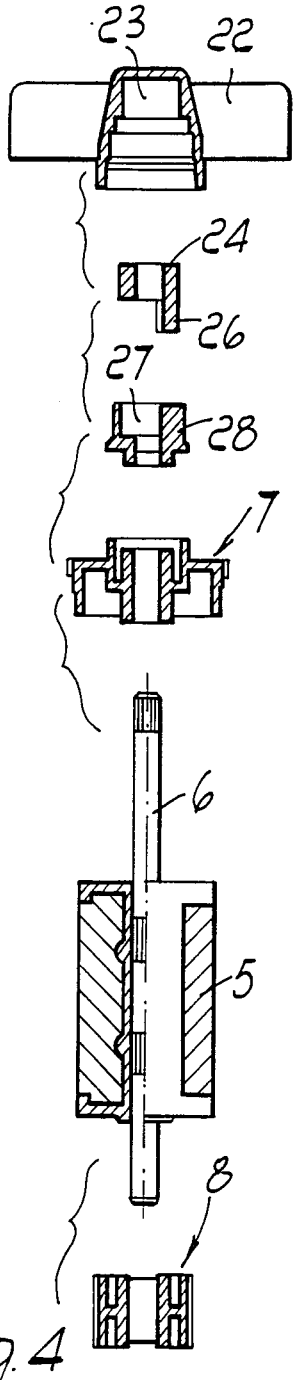
FIG. 4 is a view similar to the preceding one of the pump according to another aspect of the invention.
Figure 5:
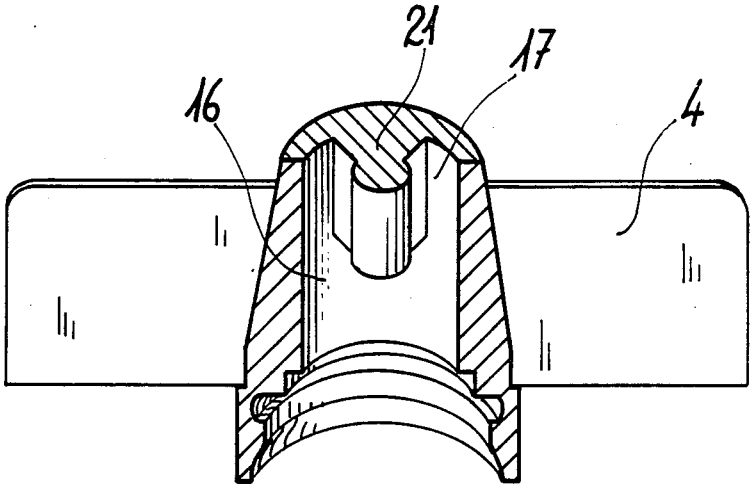
FIG. 5 is a sectional view of the impeller of FIG. 1.
Figure 6:
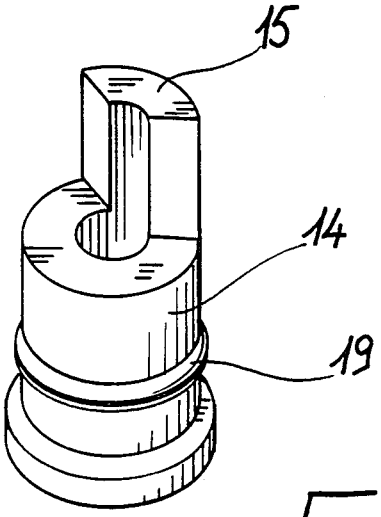
FIG. 6 is a perspective view of the means for the mechanical coupling between the rotor and the impeller.

FIG. 4 illustrates a variated aspect of the impeller/-motor shaft coupling.

In this solution, the impeller 22 has an inner cylindrical cavity 23 wherein there is contained a cylindrical metallic body 24 associated with the motor shaft 25 and provided with a non-axial frontal tab 26. The tab 26 inserts in a toroidal chamber with an extension smaller than 360 degrees, indicated at 27 and provided in a cylindrical body of plastic material which inserts, locking itself, into the chamber 23 of the impeller 22.

Also in this case the tab 26, made to rotate by the motor shaft 25 with which it is rigidly associated, after an angle of free motion interferes with the sector 28 which limits the continuity of the toroidal chamber 27, causing the actuation of the impeller 22.

The operation of the pump according to the invention is apparent from what has been illustrated and described.

The perforated sector 7 provides a complete separation between the rotor chamber and and the impeller chamber.

This prevents any body carried by the water from affecting the rotor.

The possibility of metallic particles carried by the water may be attracted by the permanent magnet from which they could then no longer detach is thus prevented.

The impeller is associated with the motor shaft so that it is initially practically free in at least one direction of rotation.

The motor, which can start in any one of the two directions, starts in the direction of nil resistance and in a first angle of rotation, smaller than 360 degrees, does not determine the actuation of the impeller.

The actuation of the impeller occurs when the tab which is free to move within the toroidal cavity does not interfere with the inner sector of said cavity.

The cavity contains a viscous fluid which acts as dampener for the motion of the tab and eliminates the noise of the contact between said tab and the inner sector of the toroidal cavity.

From what has been described and illustrated it can thus be observed that all the proposed aims and objects have been achieved and that in particular improvements have been introduced which allow a saft and long-lasting operation of the pump and furthermore allow to eliminate noise, vibrations and knockings during operation.

Naturally, starting from the same inventive concept, the embodiments may also be different from those illustrated and described.

The materials may also be chosen in any way according to the requirements and to the dimensions of the pump.

We claim:

1. Improved centrifugal pump for electric household appliances such as washing machines, dishwashers and the like, of the type having a pump body and a volute forming a waterproof container, said container enclosing a permanent magnet rotor having a shaft and an impeller in a first and in a second chamber respectively, said first and second chambers being separated by a perforated partition traversed by the shaft, said shaft being connected to said impeller by connection means comprising a tab which is contained in a toroidal cavity of said impeller, said connection means comprising a first cylindrical body associated with the end of the shaft protruding from the rotor chamber, said cylindrical body having, frontally, a non-axial tab extending for a reduced angle of approximately 90 degrees, said impeller having an axial cavity, substantially cylindrical for a first portion and toroidal for a second portion extending for less than 360 degrees and for more than the angular extension of said tab of said first cylindrical body, said first cylindrical body associated with the motor shaft having a peripheral groove adapted to partially contain an O-Ring, elastically interfering with the inner wall of said cavity of the impeller in the region in which it is cylindrical, wherein within the cavity of the impeller, closed by said O-Ring, there is contained a viscous fluid for damping and absorbing knockings and noise.

2. Centrifugal pump according to claim 1, wherein said perforated partition comprises an external cylindrical body sealingly fitted within said rotor chamber and associated by means of a deformable circular crown with a central sleeve having an axial hole adapted to contain said shaft, allowing its rotation.

3. Centrifugal pump according to claim 2, wherein said cylindrical body has an outer knurled surface adapted to engage in an equal knurling provided on the inner wall of said rotor chamber.

4. Centrifugal pump according to claim 1, wherein a second cylindrical body associated, by means of a deformable circular crown, with a perforated sleeve is provided in the innermost part of said rotor chamber, arranged axially and costituting the second support and rotation point of the motor shaft.

5. Centrifugal pump according to claim 1, wherein said tab of said cylindrical body is freely movable within said toroidal cavity of the impeller until it interferes with the sector which interrupts its extension.

* * * * *